US005961391A

United States Patent [19]

Priscella

[11] Patent Number: 5,961,391

[45] Date of Patent: Oct. 5, 1999

[54] TETHERED GOLF BALL MANUALLY ACTIVATED RETURN DEVICE

[76] Inventor: Michael A. Priscella, 7 Pond Dr., Wayland, Mass. 01778

[21] Appl. No.: 09/102,186

[22] Filed: Jun. 22, 1998

[51] Int. Cl.[6] ..... A63B 69/36

[52] U.S. Cl. ..... 473/147; 473/139

[58] Field of Search ..... 473/138, 139, 473/140, 142, 143, 144, 147, 148, 166

[56] References Cited

U.S. PATENT DOCUMENTS

| | | | |
|---|---|---|---|
| 1,541,420 | 6/1925 | Lambert | 473/147 |
| 1,555,124 | 9/1925 | Lambert | 473/147 |
| 2,469,002 | 5/1949 | Quattrin | 473/139 |
| 3,494,621 | 2/1970 | Windall | 473/147 |
| 4,125,230 | 11/1978 | Fischer | 473/142 |

*Primary Examiner*—Steven Wong
*Attorney, Agent, or Firm*—William Nitkin

[57] ABSTRACT

A tethered golf ball return device is disclosed which includes an elongated tube member with a piston disposed therein, the front end of which piston is attached to the golf ball's tether line and a pull cord is attached to the rear of the piston such that when the golf ball is struck by a golfer, the tether line pulls the piston forward which forward movement is resisted by air pressure within the tube member and which golf ball can be returned to the vicinity of the golfer by manual pulling of the pull cord which action causes the piston to return to its original location within the tube member.

8 Claims, 1 Drawing Sheet

A-A

TETHERED GOLF BALL MANUALLY ACTIVATED RETURN DEVICE

BACKGROUND OF THE INVENTION

1. Field of the Invention

The device of this invention resides in the area of golf practice devices and more particularly relates to a device utilizing a tethered golf ball with means for returning the golf ball near the location where it had been struck by the golfer for ease of retrieval by the golfer.

2. History of the Prior Art

The history of the prior art shows many examples of tethered golf balls having means to return them to the vicinity of the golfer. One of the most common means of return in such devices is by providing elasticity to the tethered line or by having a spring member incorporated therein. Of course, the problem that arises is that after striking the ball, the golfer then has the ball hurtling back toward him on the rebound which action can be disconcerting. Such spring members and elasticized cords also may direct the ball to locations other than near the golfer. Examples of such elasticized cords are found in Locurto, U.S. Pat. No. 4,660,835 where a mixture of elastic cord and non-elastic cord attaches the golf ball to a stake. Shelton et al, U.S. Pat. No. 5,108,107 also teaches the use of a combination of stretch cord and nylon cord attached to an improved ground attachment structure. Solomon, U.S. Pat. No. 5,054,786 teaches not only that elastic members can be used in the tether but also that they can be combined with spring members. Marple, U.S. Pat. No. 4,095,798 is yet another example of a cord having an elastic member attached to a stake with a swivel element. Boyer et al, U.S. Pat. No. 4,927,154 advances the art using an elastic cord with a non-elastic cord and providing means to wind up and store the cord on a reel. Bias, U.S. Pat. No. 4,989,877 also teaches a reel for cord winding and storage in combination with an anchor stake. Wiklund, U.S. Pat. No. 4,941,667 teaches the use of a reel-like structure which, when the golf ball is struck, exerts a braking influence thereon. The use of a reel to be manually rotated or rotated by a motor to help return the tethered ball to the golfer is taught in Tucker, U.S. Pat. No. 5,700,202. Black, U.S. Pat. No. 3,735,934; Moon, U.S. Pat. No. 3,826,439; Chun et al, U.S. Pat. No. 3,876,162 and Kotecki, U.S. Pat. No. 5,431,404 all teach tethered lines that are wound back onto a reel by a motor. Smith, U.S. Pat. No. 5,386,997 teaches an apparatus utilizing an elastic cord for return of a ball with means of adjusting the tension of the cord by directing it around variably positioned pins to simulate various conditions. Fischer, U.S. Pat. No. 5,125,230 utilizes a take-up reel wherein the tether cord is loosely coiled within a tube so that when the tethered golf ball is struck, the tether cord will freely exit the tube until it reaches the end of its travel wherein a motor is activated to draw the tether cord back. Mechanical structure is provided to reposition the tether cord loosely coiled within the tube. The above mentioned devices of the prior art utilizing reels can be inherently slow and time-consuming to use due to the length of the line that must wind up on the reel. Also, because of the likelihood of tangling of the tether line as it winds upon a reel device, time can be spent untangling the line before the tethered ball can be struck again by the golfer.

SUMMARY OF THE INVENTION

It is an object of this invention to provide a new device to arrest the flight of, and to return, a tethered golf ball to the vicinity of the golfer who hit such tethered golf ball. The device of this invention includes an elongated, cylindrical tube having a piston therein, the front end of which piston is part of a pulley system through which the tether line to the ball runs. At the rear end of the piston is a manual pull cord. After the ball is struck, the ball flies outward and pulls the piston forward, which piston encounters air resistance from moving within the tube wherein air pressure buildup results in increased resistance and slows the movement of the piston until the piston stops, causing the ball at the end of the no longer advancing tether line to then gently fall to the ground. To return the ball, the golfer pulls the manual pull cord attached to the rear end of the piston which cord enters the device through the rear of the tube. The piston is pulled rearward in the tube by the pulling of the pull cord; and because of the pulley system at the front of the piston, the tether line and attached ball receive a 2:1 mechanical advantage and are pulled back to the vicinity of the golfer.

The advantages of the device of this invention are that it is simple to use, works well and avoids tangling of the tether cord while further allowing the ball to be gently returned to the golfer when the golfer is ready to have the ball returned rather than having the ball immediately returned after striking it as occurs with elasticized tethered golf ball devices of the prior art.

DESCRIPTION OF THE PREFERRED EMBODIMENT(S)

Figures 1, 2, 3, 4:
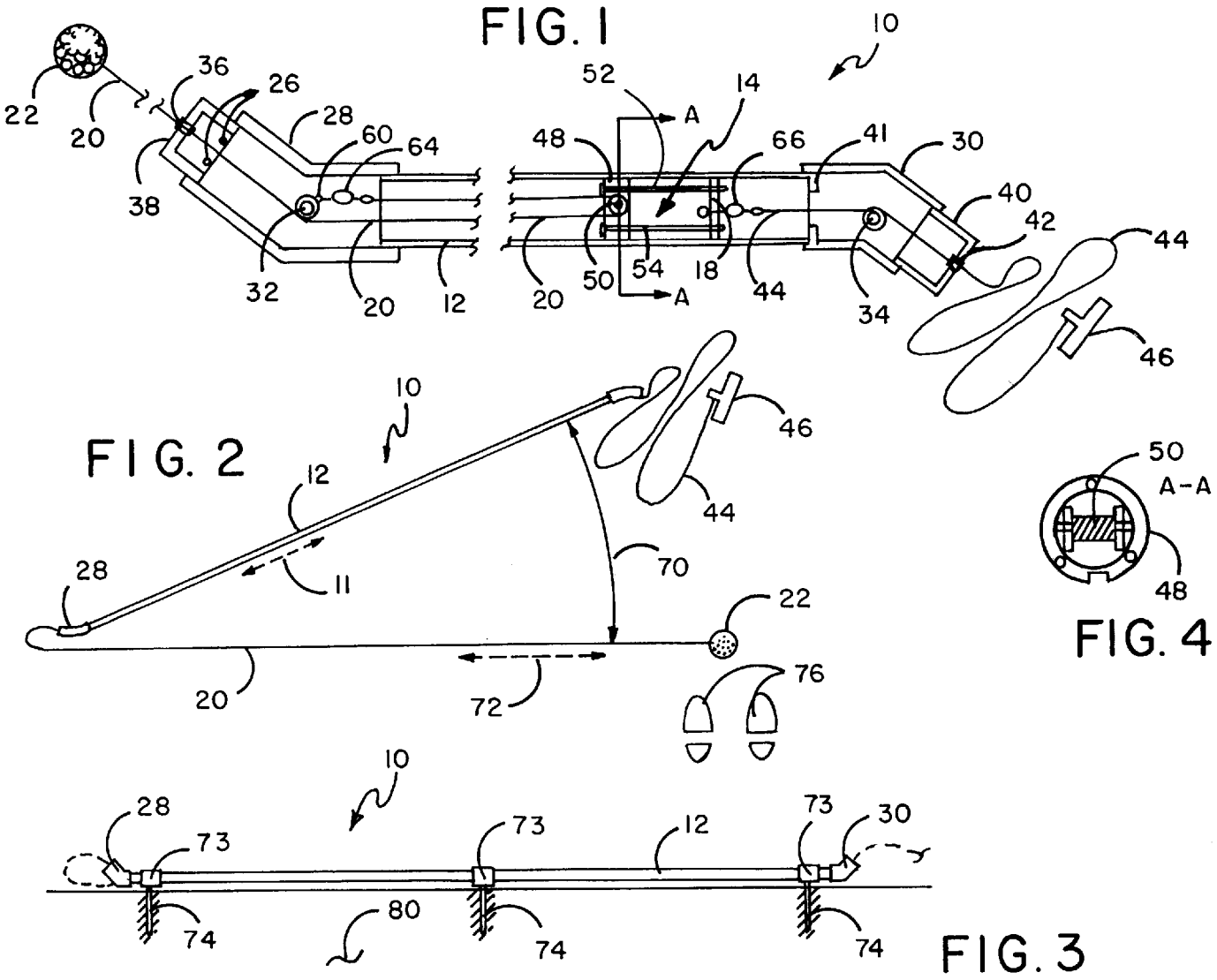
FIG. 1 illustrates a cross-sectional view through the device of this invention.
FIG. 2 illustrates a top plan view of the device of this invention on the ground with the line of travel of the ball also depicted.
FIG. 3 illustrates a side elevational view of the device of this invention showing its ground-anchoring means.
FIG. 4 illustrates a cross-sectional view of the device though A—A of FIG. 1.

FIG. 1 illustrates a cross-sectional view through the device 10 of this invention. Seen in this view is round tube 12 which in a preferred embodiment can be approximately 10 feet in length and made of 1 inch ID PVC pipe or equivalent. Tube 12 has an axis 11 running lengthwise and is substantially closed at each end, other than as described further below. Within tube 12 runs piston member 14 which is slideably engaged to move within the tube and in slideable contact therewith. When piston member 14 moves forward, it compresses air in front of it, causing its rate of travel to slow down. Golf ball 22 is attached by tether line 20 which extends through front outlet 36. Front outlet 36 is located in front end cap 38 which front end cap 38 is attached to front bend member 28. Front bend member 28 can be a 45-degree elbow attached to the front of tube 12. A rear outlet 42 is located in rear end cap 40 which is attached to rear bend member 30. Rear bend member 30 can be a 45 degree elbow attached to the rear of tube 12. Front and rear bend members 28 and 30 can be made of PVC pipe or equivalent. The front and rear end caps can be made of PVC for ¾ inch pipe with apertures formed therein. Within front and rear outlets 36 and 42 can be disposed metal eyelet bushings with apertures defined respectively therein through which the tether line and pull cord, respectively, pass. Tether line 20, which can be approximately 30 feet long and attached to golf ball 22, extends through front outlet 36 around first roller guide 32 to attach to piston member 14 by extending around pulley 50 and then forward to attach to line attachment 60 on the inside of front bend member 28. Tether line 20 can be braided nylon line or equivalent. As the ball seen in FIG. 2 is struck by the golfer whose footprints 76 are depicted in position, the ball travels along line 72 of ball travel. The golfer is standing at approximately a 90 degree angle to the line of travel of said golf ball. Axis 11 of device 10 is positioned at an angle 70 of approximately 30 degrees to the anticipated line 72 of travel of the golf ball such that as the ball in its line of flight passes over front bend 28, it pulls tether line 20 out though front outlet 36, causing piston 14 to be pulled forward within tube 12. Air pressure from air compression in front of piston 14 then slows the piston's movement eventually to a stop, causing tether line 20 to cease exiting through front outlet 36. When piston 14 stops, the ball's forward movement ceases and the ball falls gently to the ground. The speed of the deceleration of piston 14 and of the connected tethered golf ball 22 is controlled by vents 26 located in front end cap 38 which vents 26 are adjustable by rotating front end cap 38 to expose one or more vents for allowing more or less air to escape in front of piston 14 as it advances forward in tube 12. Front end cap 38 can have staggered vent holes therethrough which are sequentially exposed as front end cap 38 is rotated outward. Other equivalent means of allowing air to escape can also be incorporated into the device of this invention. Hard-hitting golfers will desire a smaller amount of air to escape to maintain more internal pressure and tension on the tether cord and ball after the ball has been struck. Other golfers will require a greater amount of air to escape due to their lesser force in striking the ball, and vents 26 can be so adjusted.

To retrieve the golf ball after hitting it, the golfer grasps handle 46 attached to pull cord 44 which is attached to the rear of piston 14. Pull cord 44 extends through rear outlet 42 disposed within rear end cap 40 which is attached to rear bend member 30. Rear bend member 30 is attached to the rear end of tube 12. A swift, steady arm's length pull of handle 46 at the end of pull cord 44 pulls piston 14 quickly rearward within tube 12 back to the piston's starting position. Stop member 41 stops the rearward movement of piston 14. Such sudden rearward movement of the piston, in turn, pulls pulley 50 rearward around which is disposed tether line 20 and also pulls tether line 20 rearward back through front outlet 36 which, in turn, smartly pulls tethered golf ball 22 back to the vicinity of the golfer who can then hit the ball again for another practice shot. The tethered golf ball of this device falling as far as 40 feet away can be returned by such single, swift, and steady arm's length pull of the pull cord.

FIG. 4 illustrates a cross-sectional view through A—A of FIG. 1, showing a spacer member 48 which is retained by pins such as first pin 52 and second pin 54 which extend through disk 18. Disk 18 can be made of nylon. First and second pins 52 and 54 hold spacer member 48 and disk 18 which can all be round to form part of piston 14. To help prevent the pull cord or the tether line from twisting due to the golf ball spinning and/or tangling of the tether line, a series of swivels, such as swivels 64 and 66 illustrated in FIG. 1, can be provided along the pull cord and tether line. First and second roller guides 32 and 34 provide rollers to make the movement of tether line 20 and pull cord 44 easier, respectively, around front bend member 28 and rear bend member 30.

FIG. 3 illustrates a side view of the device of this invention, showing tube 12 with front bend member 28 and rear bend member 30. The device has extending downward therefrom a plurality of anchor spikes 74 which can extend downward, respectively, from a like number of collar members 73 extending around tube 12, which anchor spikes can be securely pushed into and anchored in ground 80. As tube member 12 and front and rear bend members 28 and 30 of this invention can be made of PVC tubing, the entire structure can be easily and economically built.

Although the present invention has been described with reference to particular embodiments, it will be apparent to those skilled in the art that variations and modifications can be substituted therefor without departing from the principles and spirit of the invention.

I claim:

1. A practice device for use by a golfer at a given location, comprising:

a golf ball, said golf ball when hit traveling in a line of travel, said golfer standing at approximately a 90 degree angle to said line of travel of said golf ball;

an elongated tube member having an axis defined along its length, a front end and a rear end, said front end being substantially closed but having an aperture defined therein;

a tether line having a first end and a second end, said first end connected to said golf ball;

a piston having a front and a rear, said piston adapted to move back and forth within said tube member;

means to connect said second end of said tether line through said aperture in said front end of said tube member to said front of said piston, said tether line extending out said front end of said tube member such that when said golf ball is struck, said tether line pulls said piston forward within said tube member, said piston when moving forward toward said front end of said tube member adapted to compress air in front of it until the air pressure of said compressed air stops the forward movement of said piston;

air escape means located in said front of said elongated tube member for controlling the air pressure of said compressed air and the speed of said piston traveling forward within said tube member; and a pull cord attached to the rear of said piston, said pull cord extending out said rear end of said tube member, said pull cord being manually pullable by said golfer after striking said golf ball, said pull cord pulling said piston rearwards which action thereupon pulls on said tether line attached to said golf ball and pulls said golf ball back to said location of said golfer.

2. The device of claim 1 wherein said air escape means is adjustable.

3. The device of claim 2 wherein said means to connect said second end of said tether line to said front of said piston includes:

a pulley positioned at said front of said piston around which said tether line passes; and an attachment point located near said front end of said elongated tube to which said second end of said tether line is attached.

4. The device of claim 3 further including:

a front bend member having a first end and a second end, said first end attached to said front end of said elongated tube; and a rear bend member having a first end and a second end, said second end attached to said rear end of said elongated tube, said second end of said front bend member and said first end of said rear bend member aimed in opposite directions to one another.

5. The device of claim 4 further including:

a first end cap disposed within said second end of said front bend member, said first end cap having an aperture defined therein, said first end cap aperture receiving said tether line therethrough; and a second end cap disposed within said first end of said rear bend member, said second end cap having an aperture defined therein, said second end cap aperture receiving said pull cord therethrough.

6. The device of claim 5 wherein said tube member is approximately 10 feet in length.

7. The device of claim 6 further including means to anchor said tube member to the ground.

8. The device of claim 7 wherein said axis of said tube member is disposed at approximately a 30 degree angle to the line of travel of said tethered golf ball.

* * * * *